US006776801B2

(12) United States Patent
Berglund

(10) Patent No.: US 6,776,801 B2
(45) Date of Patent: Aug. 17, 2004

(54) DRY CLEANING METHOD AND APPARATUS

(75) Inventor: David N. Berglund, Cambridge, MA (US)

(73) Assignee: Sail Star Inc., Tortola (VG)

( * ) Notice: Subject to any disclaimer, the term of this patent is extended or adjusted under 35 U.S.C. 154(b) by 225 days.

(21) Appl. No.: 09/735,762

(22) Filed: Dec. 13, 2000

(65) Prior Publication Data

US 2002/0162175 A1 Nov. 7, 2002

Related U.S. Application Data

(60) Provisional application No. 60/171,044, filed on Dec. 16, 1999, and provisional application No. 60/219,727, filed on Jul. 19, 2000.

(51) Int. Cl.[7] ..... D06F 43/00
(52) U.S. Cl. ..... 8/142; 8/158
(58) Field of Search ..... 8/142, 148, 158, 8/159; 68/12.08, 12.09, 18 R, 18 C

(56) References Cited

U.S. PATENT DOCUMENTS

| | | | | |
|---|---|---|---|---|
| 400,441 A | | 4/1889 | Cooper | 8/94.15 |
| 2,161,208 A | | 6/1939 | Soderholm | 8/159 |
| 2,219,490 A | | 10/1940 | Pisarev | 8/111 |
| 3,969,196 A | | 7/1976 | Zosel | 203/49 |
| 4,012,194 A | | 3/1977 | Maffei | 8/142 |
| 4,219,333 A | | 8/1980 | Harris | 8/137 |
| 5,013,366 A | | 5/1991 | Jackson et al. | 134/1 |
| 5,123,176 A | | 6/1992 | Yamada et al. | 34/32 |
| 5,267,455 A | | 12/1993 | Dewees et al. | 68/5 |
| 5,279,615 A | | 1/1994 | Mitchell et al. | 8/142 |
| 5,316,591 A | | 5/1994 | Chao et al. | 134/34 |
| 5,339,844 A | | 8/1994 | Stanford, Jr. et al. | 134/107 |
| 5,412,958 A | | 5/1995 | Iliff et al. | 68/5 |
| 5,456,759 A | | 10/1995 | Stanford, Jr. et al. | 134/1 |
| 5,467,492 A | | 11/1995 | Chao et al. | 8/159 |
| 5,669,251 A | | 9/1997 | Townsend et al. | 68/58 |
| 5,759,209 A | | 6/1998 | Adler et al. | 8/142 |
| 5,858,022 A | | 1/1999 | Romack et al. | 8/142 |
| 5,904,737 A | | 5/1999 | Preston et al. | 8/158 |
| 5,943,721 A | * | 8/1999 | Lerette et al. | 8/158 |
| 6,212,916 B1 | * | 4/2001 | Carr | 68/18 R |
| 6,216,302 B1 | * | 4/2001 | Preston et al. | 8/158 |
| 6,260,390 B1 | * | 7/2001 | Carr | 68/18 R |
| 6,442,980 B2 | * | 9/2002 | Preston et al. | 68/18 |

FOREIGN PATENT DOCUMENTS

| | | |
|---|---|---|
| DE | 2027003 | 12/1971 |
| DE | 3904513 A1 | 8/1990 |
| DE | 4004111 A1 | 8/1990 |
| DE | 3906724 C2 | 3/1998 |
| DE | 3904514 C2 | 3/1999 |
| DE | 3906735 C2 | 4/1999 |
| EP | 0518653 A1 | 9/1995 |
| EP | 0530949 B1 | 9/1995 |
| WO | WO 90/06189 | 6/1990 |

* cited by examiner

*Primary Examiner*—Frankie L. Stinson
*Assistant Examiner*—Joseph L. Perrin
(74) *Attorney, Agent, or Firm*—Weingarten, Schurgin, Gagnebin & Lebovici LLP

(57) ABSTRACT

An apparatus and a method of operating a dry cleaning system are disclosed which utilize liquid carbon dioxide as the cleaning medium. The apparatus comprises two storage tanks in conjunction with a cleaning vessel, where one of the storage tanks is employed for pressure equalization and the other storage tank is employed for bulk solvent transfer to and from the cleaning vessel. The apparatus also comprises a return line from the cleaning vessel, which is routed back into the cleaning vessel where it forms a heat exchange coil. In the method of operating the dry cleaning system, the pressure equalization tank is used for absorbing temperature fluctuations and for providing efficient control of the transfer of the dry cleaning medium, using a compressor for subsequent bulk transfer.

10 Claims, 7 Drawing Sheets

DRY CLEANING METHOD AND APPARATUS

CROSS REFERENCE TO RELATED APPLICATIONS

This application claims priority of U.S. Provisional Patent Application No. 60/171,044, filed Dec. 16, 1999, and U.S. Provisional Patent Application No. 60/219,727, filed Jul. 19, 2000.

STATEMENT REGARDING FEDERALLY SPONSORED RESEARCH OR DEVELOPMENT

N/A

BACKGROUND OF THE INVENTION

The use of hazardous solvents such as perchlorethylene ("PERC"), a chemical suspected by the Environmental Protection Agency ("EPA") to be a carcinogen, in commercial dry cleaning systems has come under increased scrutiny in recent times. The environmental regulations and liability considerations of current solvents has generated a search for an alternative process that can compete from both an economic and performance standpoint, while remaining environmentally friendly. Alternative solvents have been proposed, most notably liquid carbon dioxide ($LCO_2$), which is available as a by-product from a variety of industrial processes, including fertilizer manufacturing.

To date, systems employing $LCO_2$ have either used a single $LCO_2$ supply tank in conjunction with a cleaning vessel, or twin $LCO_2$ supply tanks in mutual communication with a cleaning vessel. Most such systems have employed a heavy-duty, positive-displacement piston pump to provide a substantially continuous flow of $LCO_2$ through the respective system during substrate agitation.

In order to address various deficiencies associated with the use of such pumps, compressors have been proposed to circulate $LCO_2$ between a storage tank or tanks and a cleaning vessel by means of pressure differentials, obviating the need for a pump. In a single-storage tank embodiment, the compressor is employed to convey solvent to the cleaning vessel prior to agitation, then back into the storage tank after agitation; agitation itself is achieved through the use of some mechanical means, including a rotating basket or paddles, in a single-storage tank embodiment.

In a two-storage tank embodiment, a positive pressure differential enables the flow of $LCO_2$ from one storage tank to the cleaning vessel and thence to the second storage tank. The direction of solvent flow is then reversed in order to maintain the flow of solvent through the cleaning vessel. Here, the introduction of at least a portion of the liquid solvent through nozzles in the cleaning vessel results in jet agitation of the substrates. The magnitude of the pressure differential between one storage tank and the other may be controlled by varying the speed of the compressor motor or by using a throttle valve. The compressor may also be used to draw gaseous $LCO_2$ from one storage tank into the other storage tank in order to create the pressure differential.

In the prior art, it is necessary to heat gaseous $CO_2$ as it is being conveyed into the cleaning vessel during pressure equalization; as the pressurization of the gaseous $CO_2$ decreases in a first storage tank, the temperature in the first storage tank drops. This effect may be exacerbated if the cleaning vessel has been pumped down to remove water vapor prior to pressure equalization. Thus, the remaining $LCO_2$ in the first storage tank is at a temperature which is below optimal for dry cleaning purposes, requiring it to be heated prior to being transferred into the cleaning vessel for substrate agitation.

Heating the $LCO_2$ for this purpose could be done through the use of a heat exchanger in the fill line. Alternatively, one could start with a storage tank some 20 degrees C. above the target range, but this would result in significantly higher pressures, and would require a higher pressure-rated storage tank, which is of course more expensive and potentially bulkier.

At the end of the cleaning cycle, it is necessary to evacuate gaseous carbon dioxide from the cleaning vessel into one of the storage tanks. To convert carbon dioxide vapor in the cleaning vessel into a liquid for storage following a cleaning cycle, the vapor must be cooled to avoid an excessive increase in pressure.

Thus, prior art two-tank systems which exchange $LCO_2$ through a cleaning vessel require the liquid cleaning medium to be heated prior to introduction into the cleaning vessel and the gaseous carbon dioxide vapor to be cooled as it is returned to one or both of the storage tanks.

Cooling the vapor to a degree necessary to liquefy it requires a very large refrigeration system. Absent such a system, an overpressure condition might result as the vapor is pumped back into the storage tank. Plural heat exchangers with hot water and cold water reservoirs and pumps may suffice for this purpose, but are expensive and result in added system complexity.

BRIEF SUMMARY OF THE INVENTION

A dry cleaning system is disclosed which in a preferred embodiment utilizes liquid carbon dioxide as the cleaning medium. Two storage tanks are employed, one of which is relatively "cold" and the other being relatively "hot." These tanks are alternatively referred to herein as the "thermo tank" and the "solvent tank," respectively. Substrate washing is performed in a cleaning vessel, which for liquid carbon dioxide is maintained at 20–24 degrees C.

After loading the substrates to be washed, such as clothing, into the cleaning vessel, the pressure in the thermo tank and in the cleaning vessel is equalized by placing the cleaning vessel and thermo tank in vapor communication. The temperature of the residual solvent, which remains in the thermo tank throughout the cleaning process, is allowed to drop as the pressure decreases. A compressor is used to force additional gaseous solvent into the cleaning vessel, raising the pressure therein to a point closer to the internal pressure of the solvent tank. Then, the solvent tank and the cleaning vessel are placed in fluid communication so that the cleaning vessel is filled with $LCO_2$ through operation of the compressor. It is preferred to pressurize the cleaning vessel by connecting the thermo tank to the cleaning vessel prior to filling the cleaning vessel with $LCO_2$, otherwise ice or "snow" would form in the cleaning vessel, which may block the lines and valves to the cleaning vessel.

Once the thermo tank is placed in vapor communication with the cleaning vessel, the temperature of the liquid carbon dioxide in the thermo tank drops as some of it vaporizes during pressure equalization. This drop can be 20 degrees C. lower than the starting temperature. Then, as further gaseous $CO_2$ is compressed out of the thermo tank and into the cleaning vessel, more liquid $CO_2$ evaporates, resulting in a further temperature drop on the order of 40 degrees C. Thus, the total drop in temperature in the thermo tank is close to 60 degrees C. This effect may be increased in one embodiment where the cleaning vessel has been pumped down to −14 psi initially to remove water vapor which would otherwise have a deleterious effect on substrate cleaning. In other cases, however, the amount of water vapor in the cleaning vessel initially may be so small as to not require initial evacuation.

At the completion of substrate agitation, $LCO_2$ is transferred back into the solvent tank, following which gaseous $CO_2$ is extracted and condensed into the thermo tank. This process reduces the temperature of the cleaning vessel and substrates to the point where damage can occur to the cleaning vessel contents; some plastic and vinyl materials crack at sub-freezing temperatures. Clothing is also more prone to wrinkle at lower temperatures.

Conversely, at the end of the cleaning cycle, the gaseous $CO_2$ which is removed from the cleaning vessel becomes hotter as a result of compression. In order to employ this latent heat energy, the return line from the cleaning vessel to the thermo tank is routed back into the cleaning vessel where it forms a heat exchange coil below a rotary basket used for substrate agitation. In order to raise the temperature of the residual $LCO_2$ in the thermo tank and complete the condensation of the hot, compressed, gaseous $CO_2$ extracted from the cleaning vessel, the gaseous $CO_2$ is introduced back into the thermo tank through a sparging tube, such that small gas bubbles of heated $CO_2$ efficiently transfer heat to the liquid-phase $CO_2$.

BRIEF DESCRIPTION OF THE SEVERAL VIEWS OF THE DRAWING

FIGS. 1 through 7 illustrate the connectivity of a dry-cleaning system according to the present invention, in which:

FIG. 1 illustrates an air evacuation stage;

FIG. 2 illustrates a pressure equalization stage;

FIG. 3 illustrates a cleaning vessel fill stage;

FIG. 4 illustrates a substrate agitation stage;

FIG. 5 illustrates a cleaning vessel drain stage;

FIG. 6 illustrates a vapor recovery stage; and

FIG. 7 illustrates a cleaning vessel vent stage.

DETAILED DESCRIPTION OF THE INVENTION

Figure 1:
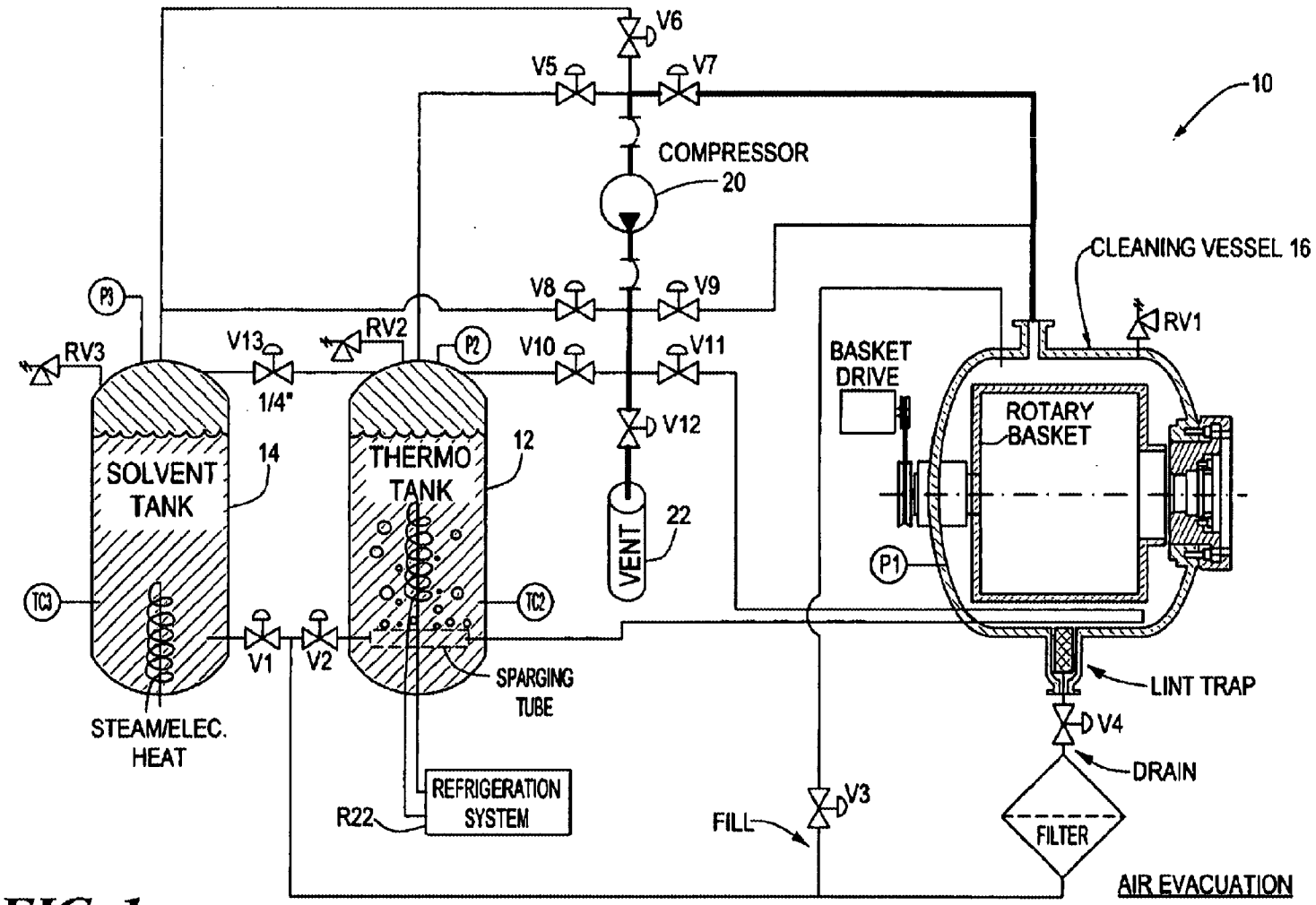

To address the problems associated with the prior art, the present disclosure provides a two tank system 10, including a "cold" or "thermo" tank 12 for pressure equalization and vapor recovery, and a "hot" or "solvent" tank 14 for bulk liquid carbon dioxide transfer, in addition to a cleaning vessel 16. FIG. 1 illustrates the arrangement of valves, plumbing and a compressor 20, along with a vent manifold 22, which enable water vapor evacuation; other specific arrangements are possible in order to achieve the same result.

Throughout the accompanying illustrations, bold lines indicate the fluid flow path. Valve designations begin with the letter "V," relief valve designations begin with the letters "RV," pressure transducers are denoted by "P," and thermocouples are denoted by "TC."

The thermo tank 12 is filled in one embodiment with approximately 50 gallons of liquid carbon dioxide. The quantity employed depends, in part, upon the volume of the cleaning vessel 16 of the system 10. During pressure equalization, some 20 gallons of $LCO_2$ may be lost to vapor, dropping the temperature in the thermo tank 12 from about 20 degrees C. to about zero (+/−5 degrees C.). The remaining 30 gallons stay of $LCO_2$ in the thermo tank 12. As mentioned previously, this effect may be exacerbated if the cleaning vessel 16 is initially evacuated in order to minimize the quantity of water vapor in the cleaning vessel 16 prior to the cleaning cycle. This preliminary evacuation is optional, however, depending upon the quantity of water vapor initially present in the cleaning vessel, and upon the relative impact on the cleaning process posed by such water vapor.

Figure 2:
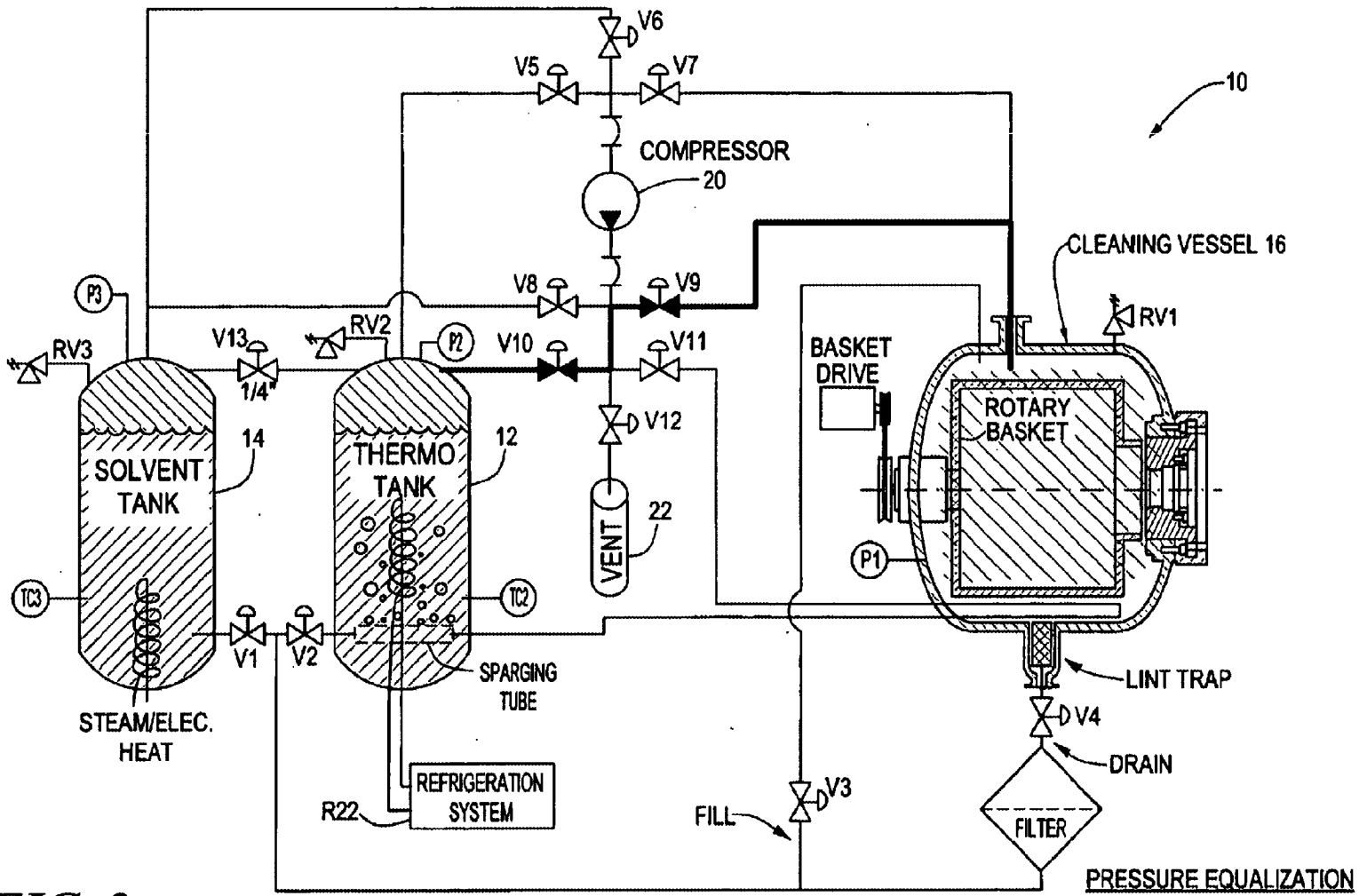
Figure 3:
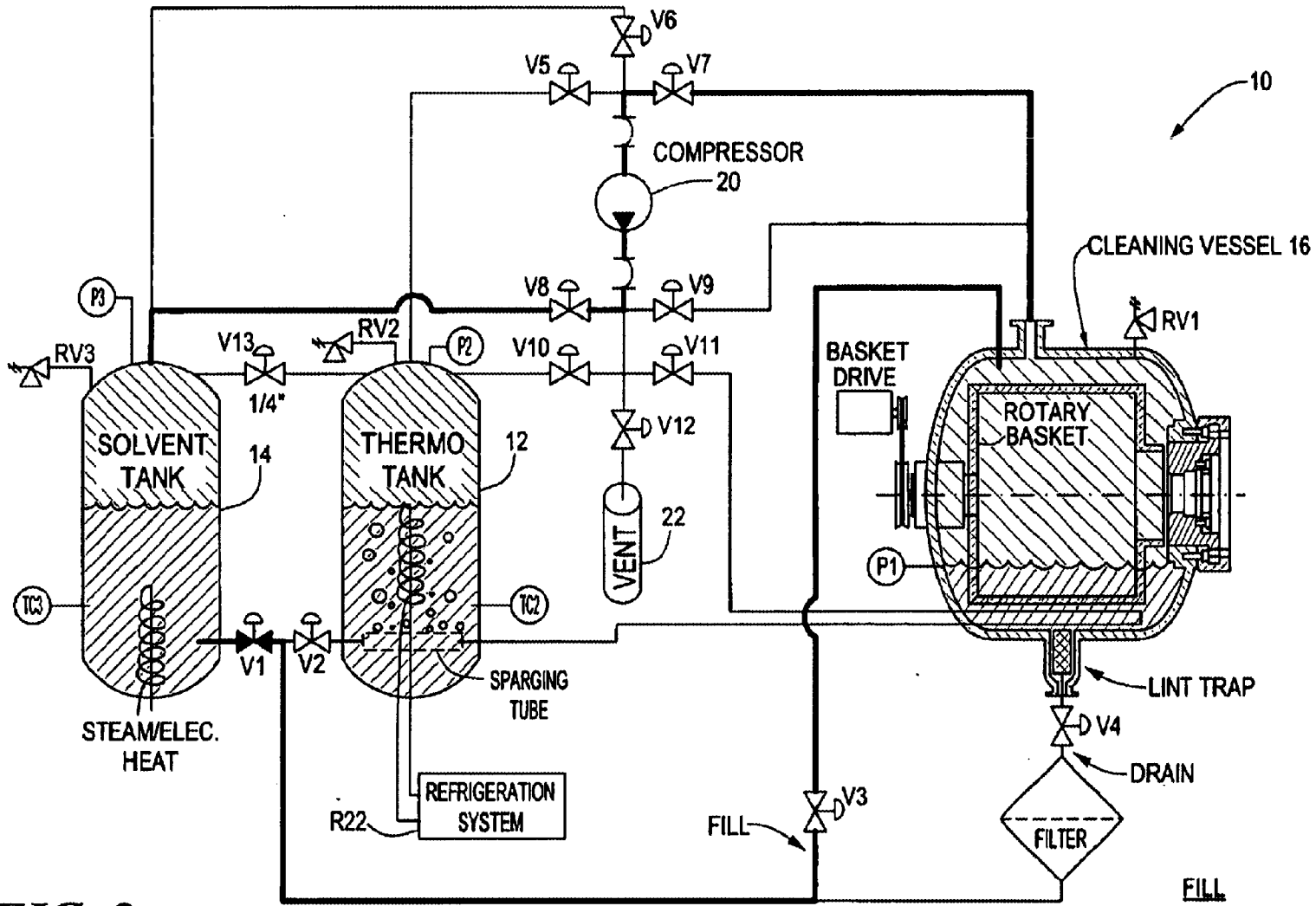

Due to the vaporization of the thermo tank 12 liquid carbon dioxide, and depending upon the initial pressurization of both containers 12, 16, the thermo tank 12 and the cleaning vessel 16 may equalize at roughly 450 psi, below the target of 750 psi (FIG. 2). To compensate for this differential, the compressor 20 is used in one embodiment to transfer further gaseous carbon dioxide from the thermo tank 12 to the cleaning vessel 16, further lowering the temperature in the thermo tank 12. Even with additional pressurization of the cleaning vessel 16, it is likely that the cleaning vessel 16 internal pressure will be below that of the solvent tank 14. Thus, when the solvent tank 14 is connected to the cleaning vessel 16 for bulk fluid transfer (FIG. 3), further vaporization may occur in the solvent tank 14, but not enough to draw the temperature of the solvent tank 14 down below acceptable levels.

Bulk liquid transfer is carried out through the use of the compressor 20 pressurizing the solvent tank 14 while the solvent tank 14 and cleaning vessel 16 are in liquid communication through the "FILL" line.

Figure 4:
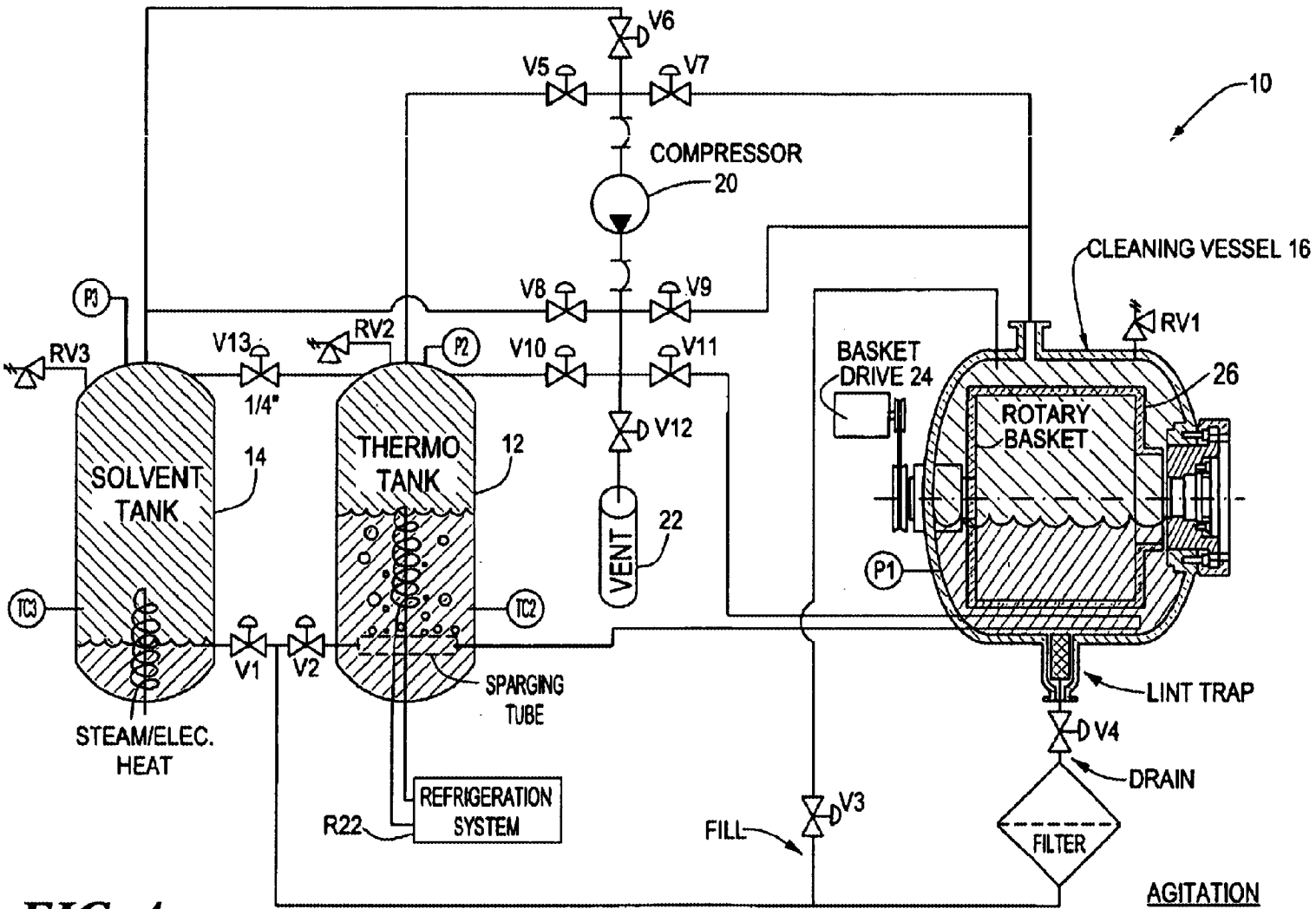

Once liquid carbon dioxide from the higher pressure solvent tank 14 has flowed into the lower pressure cleaning vessel 16, substrate agitation may be enabled (FIG. 4) through the use of a rotary basket 26 driven by a basket drive 24, with or without the use of jets of pressurized liquid carbon dioxide.

In one preferred embodiment, the cleaning vessel internal pressure is raised through operation of the compressor 20 in order to raise the internal temperature of the cleaning vessel 16, thus enhancing the cleaning efficiency of the process. For this purpose, the compressor is connected to the thermo tank 12, resulting in a further lowering of the thermo tank 12 internal pressure. This has the added benefit of enabling the transfer of new liquid carbon dioxide from a low-pressure external source to the thermo tank 12. Valve-controlled conduits interconnecting the thermo tank 12 and the solvent tank 14 enable the appropriate distribution of solvent at a convenient interval.

Figure 5:
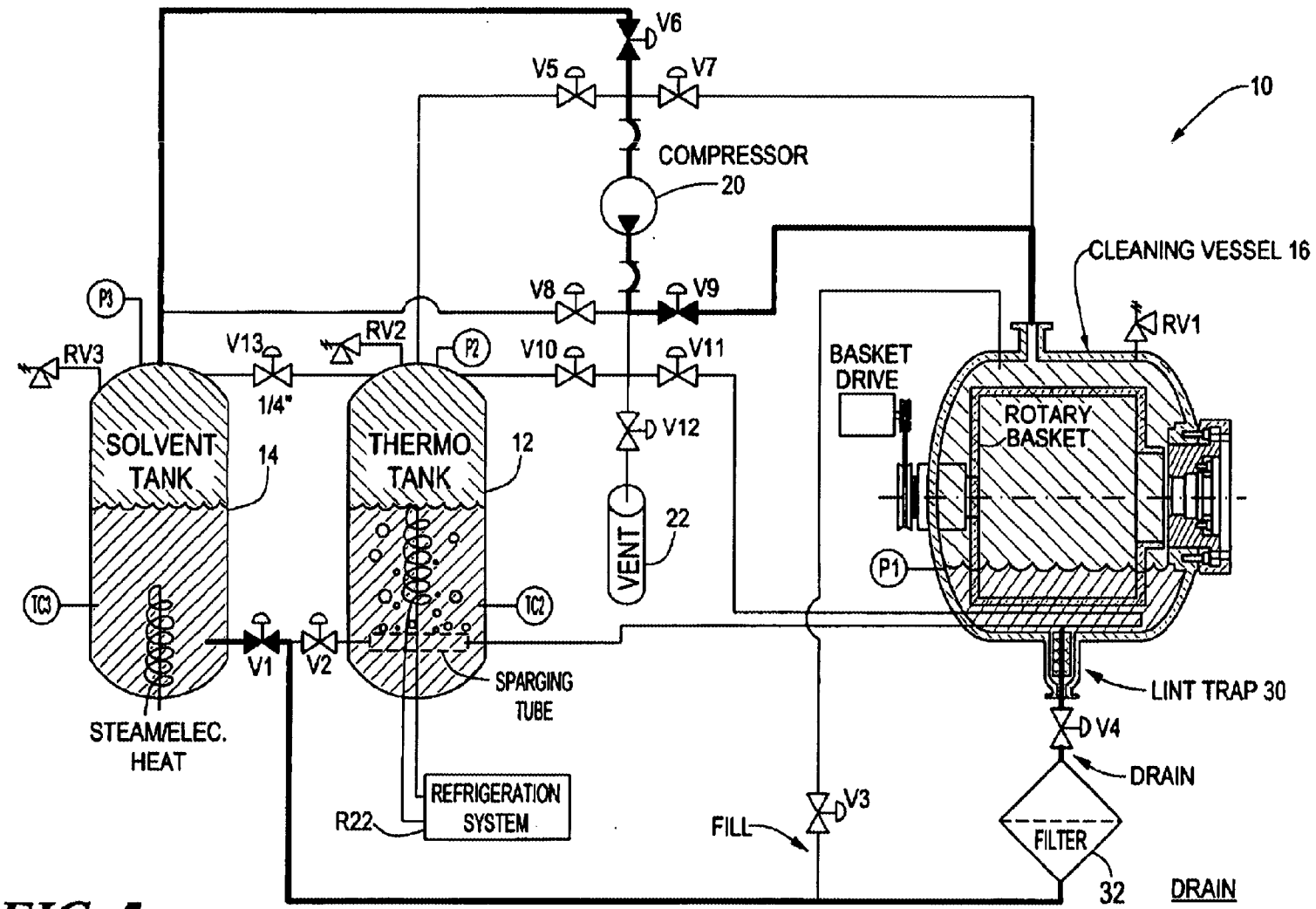

Following a suitable period of time, the cleaning vessel 16 and the solvent tank 14 are once again placed in fluid communication (FIG. 5), and the compressor 22 is used to pressurize the cleaning vessel 16, forcing the liquid carbon dioxide back into the solvent tank 14. A lint trap 30, preferably accessible from within the cleaning vessel 16, and a filter 32 form a "DRAIN" for the purpose of conditioning the liquid carbon dioxide prior to re-introduction into the solvent tank 14.

Figure 6:
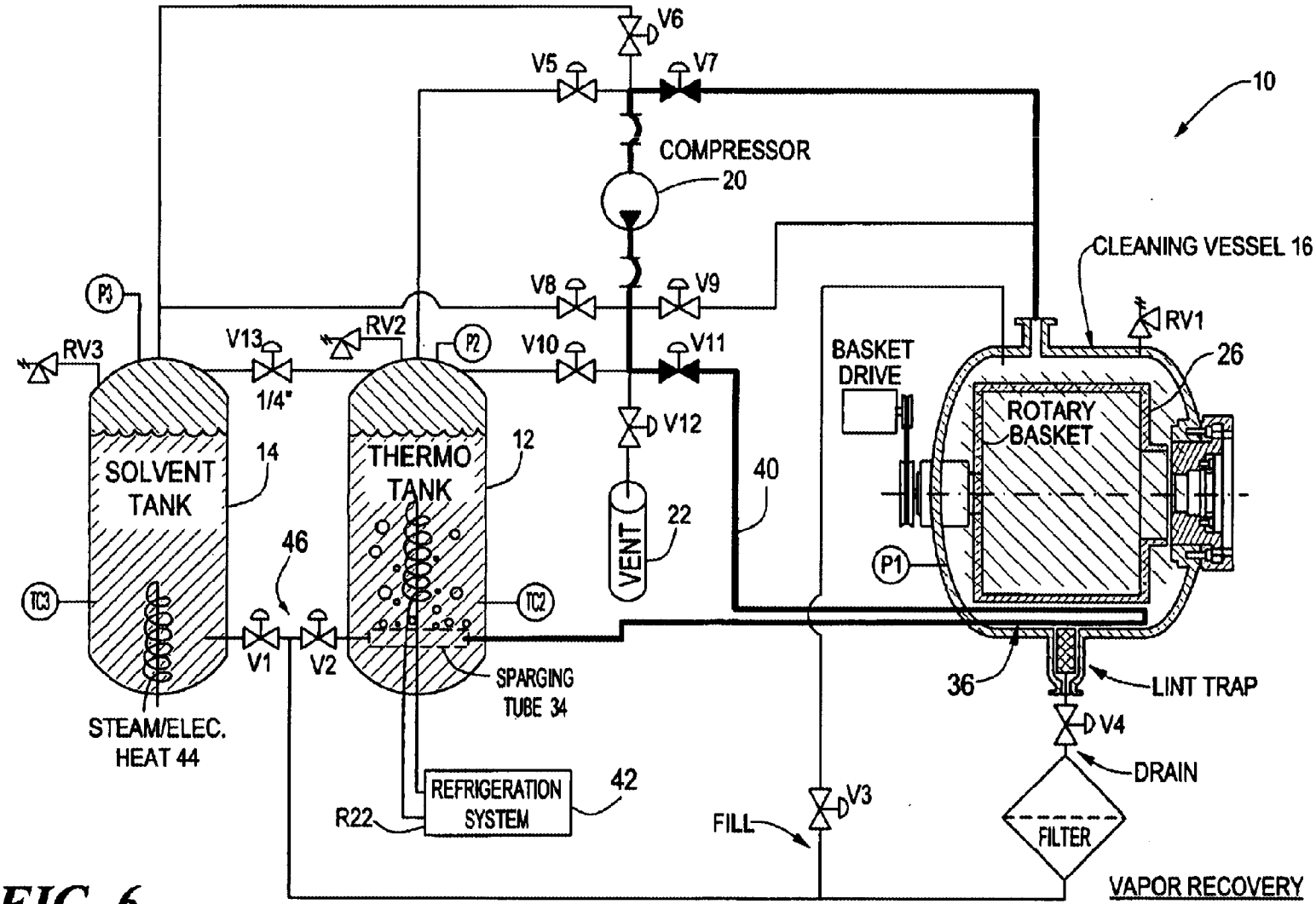
Figure 7:
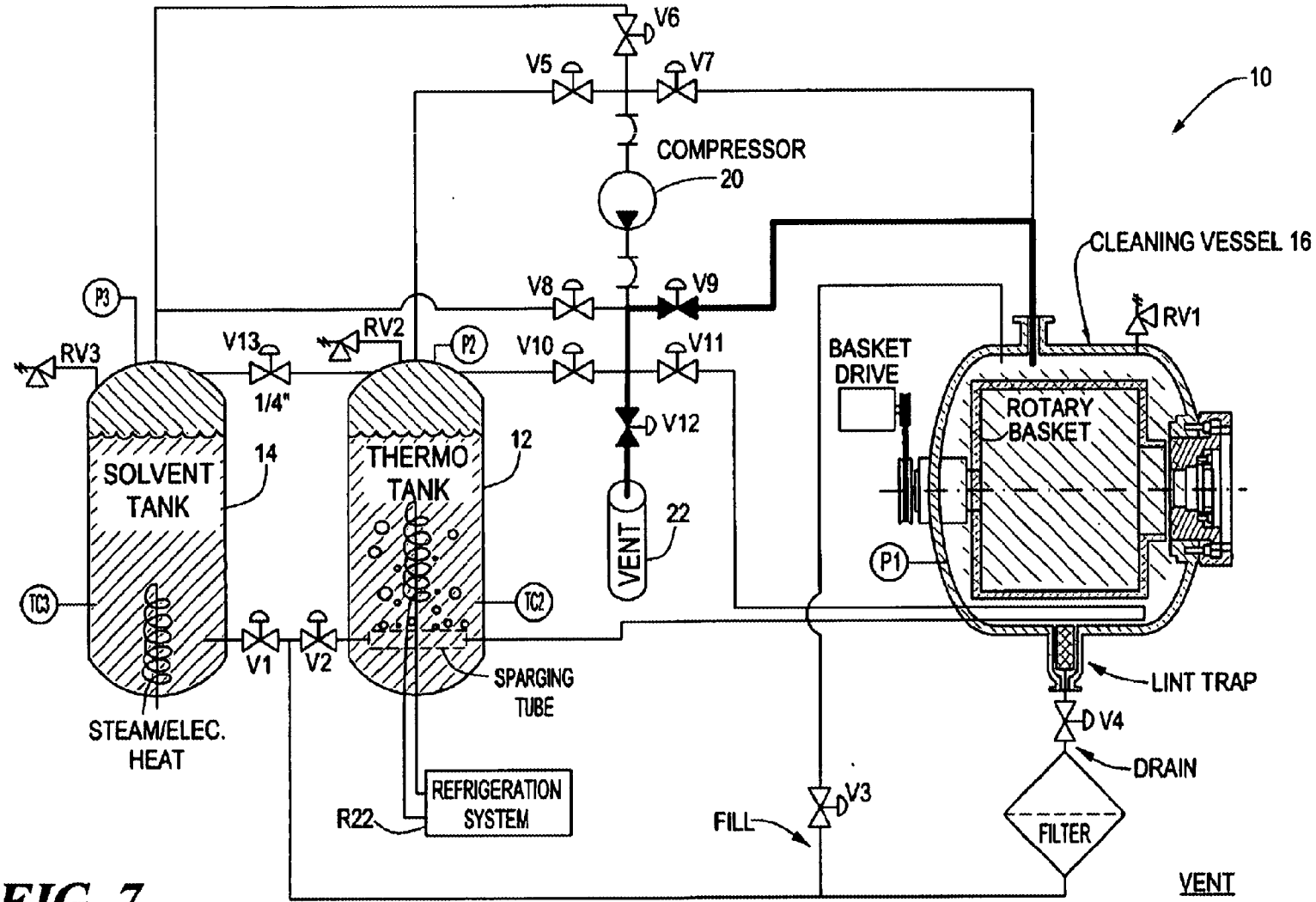

Following the draining of the cleaning vessel 16, the next stage is vapor recovery from the cleaning vessel 16 into the thermo tank 12 (FIG. 6). As the vapor is compressed out of the cleaning vessel 16, by action of the compressor 20, it is heated as a by-product of its being compressed into the thermo tank 12, the pressure rising to approximately 900 psi in one embodiment. At the same time, the cleaning vessel 16 cools as residual liquid carbon dioxide in the clothes evaporates, the cleaning vessel internal pressure dropping to about 300 psi.

The heat in the vapor recovery line 40 is preferably used to heat the cleaning vessel 16 to avoid freezing and damaging the substrates and/or harming an operator's hands when substrates are removed from the cleaning vessel 16. This is accomplished by forming a coil 36 out of the hot vapor return line 40 between the compressor 20 output and the thermo tank 12. The coil 36 is located within the cleaning vessel 16, beneath the rotary basket 26 in one embodiment, though other specific arrangements are possible. Thus, separate features for cleaning vessel 16 heating are not required, shortening the cleaning cycle time and simplifying the equipment comprising the system. In another embodiment, it is preferable to include a heating element in association with specific portions of the cleaning vessel 16, such as the lint trap 30. The transfer of heat out of the vapor and into the cleaning vessel 16 interior tends to eliminate or at least reduce the super-heat in the vapor. This has the beneficial effect of bringing the vapor temperature at the input to the thermo tank 12 to a point closer to the condensation temperature of the carbon dioxide (at the 900 psi state of the thermo tank 12).

As the vapor is re-introduced into the thermo tank 12, removal of the latent heat in the vapor results in the elevation of the temperature of the liquid carbon dioxide in the thermo tank 12 from the reduced point which follows initial pressure equalization. This latent heat transfer is accomplished by introducing the heated vapor into the bottom of the thermo tank 12, and preferably through a sparging tube 34 in the bottom of the thermo tank 12. The carbon dioxide bubbles thus formed are dispersed in the tank, offering a large surface area for heat transfer to the liquid phase. Thus, the need for a heat exchanger (i.e., a chiller) for the vapor recovery line is avoided.

It may still be necessary to provide a trim chiller 42 in the thermo tank to offset some of the heat resulting from vapor recovery. Such a chiller 42 can take the form of an R22 refrigerant coil, a chilled water coil from an on-board cooling system, or simply (and preferably) a chilled water coil fed from an on-site supply of chilled water.

In another embodiment, it may be that the residual $CO_2$ in the thermo tank 12 is not large enough to provide sufficient cooling capacity. In this case, it may be necessary to provide a refrigeration circuit in conjunction with the thermo tank 12. One such embodiment employs a flat plate R22 to $CO_2$ heat exchanger and a 12 hp R22 compressor.

Likewise, the solvent tank may be provided with a trim heater 44, such as a resistive heater coil or steam radiator, to maintain the proper temperature. If the temperature in the tanks 12, 14 are to be offset in opposite directions, temperature balancing can be accomplished in one embodiment through an exchange of liquid carbon dioxide between the tanks through appropriate plumbing 46 and the use of the compressor 20.

The final step in the process is to vent any residual gaseous carbon dioxide through the vent manifold 22.

While not illustrated, it is to be understood that a suitable control circuit, preferably including some form of microprocessor, is utilized to control the timely operation of the compressor 20, and the valves associated with the system. The thermocouples and pressure sensors illustrated in association with the thermo tank 12, solvent tank 14 and cleaning vessel 16 preferably provide respective inputs to this control circuit. A memory associated with the control circuit maintains software or firmware necessary for implementing the control function in response to input from these sensors and from an operator.

Also in communication with the control circuit, but not illustrated, is a control panel with feedback element, enabling operator control over the cleaning system. The control panel may include a keyboard, keypad or other actuators in one embodiment, while the feedback element may be any combination of alphanumeric display screen, and visual or audio annunciators. In addition, a touch-sensitive screen may be provided as both the means for receiving operator input and conveying information back to the operator.

In a further embodiment, the control circuit is provided with an interface circuit for enabling communication via local or distributed data network, including wired and wireless LAN or WAN, Internet, or other data channel. The control circuit may be further provided with the ability to log and report data reflective of system performance or errors.

These and other examples of the invention illustrated above are intended by way of example and the actual scope of the invention is to be limited solely by the scope and spirit of the following claims.

What is claimed is:

1. A method of operating a dry-cleaning system, comprising:

disposing substrates to be dry-cleaned into a cleaning vessel;

evacuating air and water vapor from the interior of the cleaning vessel to the atmosphere;

establishing a first gas flow path between a first storage vessel containing a dry-cleaning medium and the cleaning vessel for equalizing the internal pressures of the first storage vessel and the cleaning vessel;

de-establishing the first gas flow path;

establishing a first liquid fluid flow path between a second storage vessel containing the dry-cleaning medium and the cleaning vessel and a second gas flow path through a compressor between the cleaning vessel and the second storage vessel for conveying liquid dry-cleaning medium from the second storage vessel to the cleaning vessel and for extracting gaseous dry-cleaning medium from the cleaning vessel into the second storage vessel;

de-establishing the first liquid and second gas flow paths;

agitating the substrates in the cleaning vessel;

establishing a second liquid flow path between the cleaning vessel and the second storage vessel and a third gas flow path through the compressor between the second storage vessel and the cleaning vessel for conveying liquid dry-cleaning medium from the cleaning vessel to the second storage vessel and for returning gaseous dry-cleaning medium to the cleaning vessel;

de-establishing the second liquid and third gas flow paths;

establishing a fourth gas flow path through the compressor between the cleaning vessel and the first storage vessel for evacuating gaseous dry-cleaning medium from the cleaning vessel to the first storage vessel;

de-establishing the fourth gas flow path; and adjusting the cleaning vessel internal pressure to atmospheric pressure by admitting air into the cleaning vessel.

2. The method of claim 1, wherein establishing the first gas flow path, the first fluid flow path, and the second fluid flow path each comprises selectively operating valves associated with conduits interconnecting the respective first or second storage vessel and the cleaning vessel.

3. The method of claim 1, wherein establishing the second, third and fourth gas flow paths each comprises selectively operating the compressor and valves associated with conduits interconnecting the respective first or second storage vessel and the cleaning vessel.

4. The method of claim 1, wherein establishing the first gas flow path further includes establishing a first gas flow path through the compressor for conveying gaseous dry-cleaning medium into the cleaning vessel.

5. The method of claim 1, wherein establishing the fourth gas flow path comprises conducting the gaseous dry-cleaning medium through a heat exchanging conduit disposed within the cleaning vessel.

6. The method of claim 1, wherein establishing the fourth gas flow path comprises conducting the gaseous dry-cleaning medium through an aperture into a lower portion of the first storage vessel thereby enabling heat transfer from the gaseous dry-cleaning medium to liquid dry-cleaning medium disposed in the first storage vessel.

7. The method of claim 1, further comprising the step of maintaining the first storage vessel at a temperature below that of the second storage vessel.

8. The method of claim 1, wherein said method further comprises the step of heating the second storage vessel and contents thereof with a trim heater.

9. The method of claim 1, wherein said method further comprises the step of cooling the first storage vessel and contents thereof with a cooling element.

10. The method of claim 1, wherein said dry-cleaning medium is liquid carbon dioxide.

* * * * *